US008358945B2

(12) United States Patent
Kunii

(10) Patent No.: US 8,358,945 B2
(45) Date of Patent: Jan. 22, 2013

(54) FIXING DEVICE, IMAGE FORMING APPARATUS INCLUDING SAME, AND CONTROL METHOD FOR FIXING DEVICE

(75) Inventor: Hiroyuki Kunii, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 368 days.

(21) Appl. No.: 12/719,326

(22) Filed: Mar. 8, 2010

(65) Prior Publication Data

US 2010/0232818 A1 Sep. 16, 2010

(30) Foreign Application Priority Data

Mar. 11, 2009 (JP) ..... 2009-058207

(51) Int. Cl.
*G03G 15/00* (2006.01)
*G03G 15/20* (2006.01)

(52) U.S. Cl. ..... 399/45; 399/69; 399/70

(58) Field of Classification Search ..... 399/23, 399/44, 45, 69, 70, 389
See application file for complete search history.

(56) References Cited

U.S. PATENT DOCUMENTS

| | | | | |
|---|---|---|---|---|
| 6,223,005 | B1 * | 4/2001 | Rush et al. | 399/45 |
| 6,810,220 | B2 * | 10/2004 | Hamada et al. | 399/69 |
| 6,957,036 | B2 | 10/2005 | Kikuchi et al. | |
| 7,010,257 | B2 | 3/2006 | Someya et al. | |
| 7,031,648 | B2 | 4/2006 | Takashi et al. | |
| 7,127,202 | B2 | 10/2006 | Fujita et al. | |
| 7,139,520 | B2 | 11/2006 | Echigo et al. | |
| 7,177,580 | B2 | 2/2007 | Nakafuji et al. | |
| 7,212,762 | B2 * | 5/2007 | Watabe | 399/70 |
| 7,233,762 | B2 | 6/2007 | Kunii et al. | |
| 7,254,362 | B2 | 8/2007 | Kikuchi et al. | |
| 7,269,384 | B2 | 9/2007 | Someya et al. | |
| 7,299,003 | B2 | 11/2007 | Kurotaka et al. | |
| 7,333,760 | B2 | 2/2008 | Baba et al. | |
| 7,359,666 | B2 | 4/2008 | Takashi et al. | |
| 7,369,803 | B2 | 5/2008 | Echigo et al. | |
| 7,433,641 | B2 | 10/2008 | Kikuchi et al. | |
| 7,526,242 | B2 | 4/2009 | Takagaki et al. | |
| 7,570,911 | B2 | 8/2009 | Nakafuji et al. | |
| 7,583,922 | B2 | 9/2009 | Takashi et al. | |
| 2005/0158075 | A1 | 7/2005 | Echigo et al. | |
| 2006/0013624 | A1 | 1/2006 | Kurotaka et al. | |
| 2006/0088349 | A1 | 4/2006 | Someya et al. | |
| 2008/0253789 | A1 | 10/2008 | Yoshinaga et al. | |
| 2009/0169232 | A1 | 7/2009 | Kunii et al. | |

FOREIGN PATENT DOCUMENTS

| | | |
|---|---|---|
| JP | 2001-282041 | 10/2001 |
| JP | 2003-186346 | 7/2003 |

* cited by examiner

*Primary Examiner* — Sandra Brase
(74) *Attorney, Agent, or Firm* — Oblon, Spivak, McClelland, Maier & Neustadt, L.L.P.

(57) ABSTRACT

A fixing device includes a fixing member, a heating member to heat the fixing member, a pressing member to press against the fixing member with a predetermined pressure, forming a nip where an image is fixed on a recording medium with heat and pressure, a heating controller to cause the heating member to heat the fixing member to a predetermined temperature set in advance and to preheat the fixing member while maintaining the temperature of the fixing member, a recording-medium data receiver to acquire recording-medium data before a fixing process is started, and a preheating-time adjuster to adjust a preheating time during which the heating member preheats the fixing member based on the data acquired by the recording-medium data receiver.

20 Claims, 6 Drawing Sheets

FIXING DEVICE, IMAGE FORMING APPARATUS INCLUDING SAME, AND CONTROL METHOD FOR FIXING DEVICE

CROSS-REFERENCE TO RELATED APPLICATIONS

This patent specification claims priority from Japanese Patent Application No. 2009-058207, filed in the Japan Patent Office on Mar. 11, 2009, which is hereby incorporated by reference herein in its entirety.

BACKGROUND OF THE INVENTION

1. Field of the Invention

The present invention relates to a fixing device to fix images on recording medium, and an image forming apparatuses incorporating the fixing device.

2. Discussion of the Background

Image forming apparatuses, such as printers, facsimile machines, copiers, plotters, or multi-functional peripherals having several of the foregoing functions, typically include a fixing device that fixes a toner image on a recording medium, such as a paper sheet or overhead projection films (OHP) (hereinafter "sheet"), by heating and pressing the toner image onto the sheet. That is, fixing devices installed in image forming apparatuses execute a fixing process such that heat and pressure are exerted against the sheet to melt the toner, and the toner thus melted is adhered to the sheet.

Such fixing devices include a heating member such as a halogen heater or an induction heating (IH) coil, a fixing member heated by the heating member, and a pressing member that presses against the fixing member with a predetermined pressure. In the fixing process, initially, the heating member heats the fixing member to a predetermined temperature set in advance (hereinafter "fixing temperature"), as part of a reload process (also known as warm-up). Then, after the reload process is finished, the sheet passes between the fixing member and the pressing member, and the image is fixed on the sheet with heat and pressure.

Herein, in the above-described fixing devices, during the fixing process, the fixing member is deprived of a certain amount of heat by the sheet. Therefore, when a great number of sheets are outputted, temperature of the fixing member is decreased. Moreover, although the heating member heats the fixing member to return the temperature of the fixing member to the fixing temperature, the fixing process cannot be started until the fixing member recovers the fixing temperature.

In view of the foregoing, several approaches, described below, have been tried.

In one known method, considering the decrease in the temperature in continuous fixing, the temperature of the fixing member is varied depending on the number of sheets processed. Thus, when the number of sheets is greater, the fixing member is set to a higher temperature to prevent fixing failures. Conversely, when the number of sheets is smaller, the fixing member is set to a lower temperature to reduce a reload time.

However, although the setting temperature of the fixing member is raised when the number of the sheets is greater, the temperature of the fixing member is decreased as the fixing process is performed continuously. Therefore, the amount of heat given to the sheet greatly differs between the initial sheet and the final sheet, and fixing failures, such as unevenness in gloss of images, or unevenness in curl amount of the sheet may occur.

In another known method, pressure between the fixing member and the pressing member is changed based on the sheet size, type of sheet, and the number of sheets output in a continuous fixing process to change the temperature of the fixing member, thereby reducing the reload time while preventing the fixing failure.

However, in this known approach, because the structure of the fixing device is more complicated and the pressure between the fixing member and the pressing member can fluctuate significantly, the image quality, such as image gloss, may fluctuate significantly as well.

Accordingly, there is a need for a technology to improve the fixing reliability and shorten the reload time of the fixing device.

SUMMARY

In view of the foregoing, one illustrative embodiment of the present invention provides a fixing device that includes a fixing member, a heating member, a pressing member, a heating controller, a recording-medium data receiver, and a preheating-time adjuster. The heating member heats the fixing member, the pressing member presses against the fixing member with a predetermined pressure, forming a nip where an image is fixed on a recording medium with heat and pressure. The heating controller causes the heating member to heat the fixing member to a predetermined temperature set in advance and preheats the fixing member while maintaining the temperature of the fixing member. The recording-medium data receiver acquires recording-medium data before a fixing process is started. The preheating-time adjuster adjusts a preheating time during which the heating member preheats the fixing member based on the data acquired by the recording-medium data receiver.

Another illustrative embodiment of the present invention provides an image forming apparatus that includes an image forming unit to form an image and the fixing device described above to fix the image formed by the image forming unit onto a recording medium.

Another illustrative embodiment of the present invention provides a control method for a fixing device including a fixing member, a heating member, and a pressing member. The control method includes acquiring recording-medium data that is data about a recording medium on which an image is fixed before a fixing process is started, determining a preheating time during which the heating member preheats the fixing member based on the acquired recording-medium data, heating the fixing member to a predetermined temperature set in advance, and preheating the fixing member for the determined preheating time while maintaining the temperature of the fixing member at the predetermined temperature.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
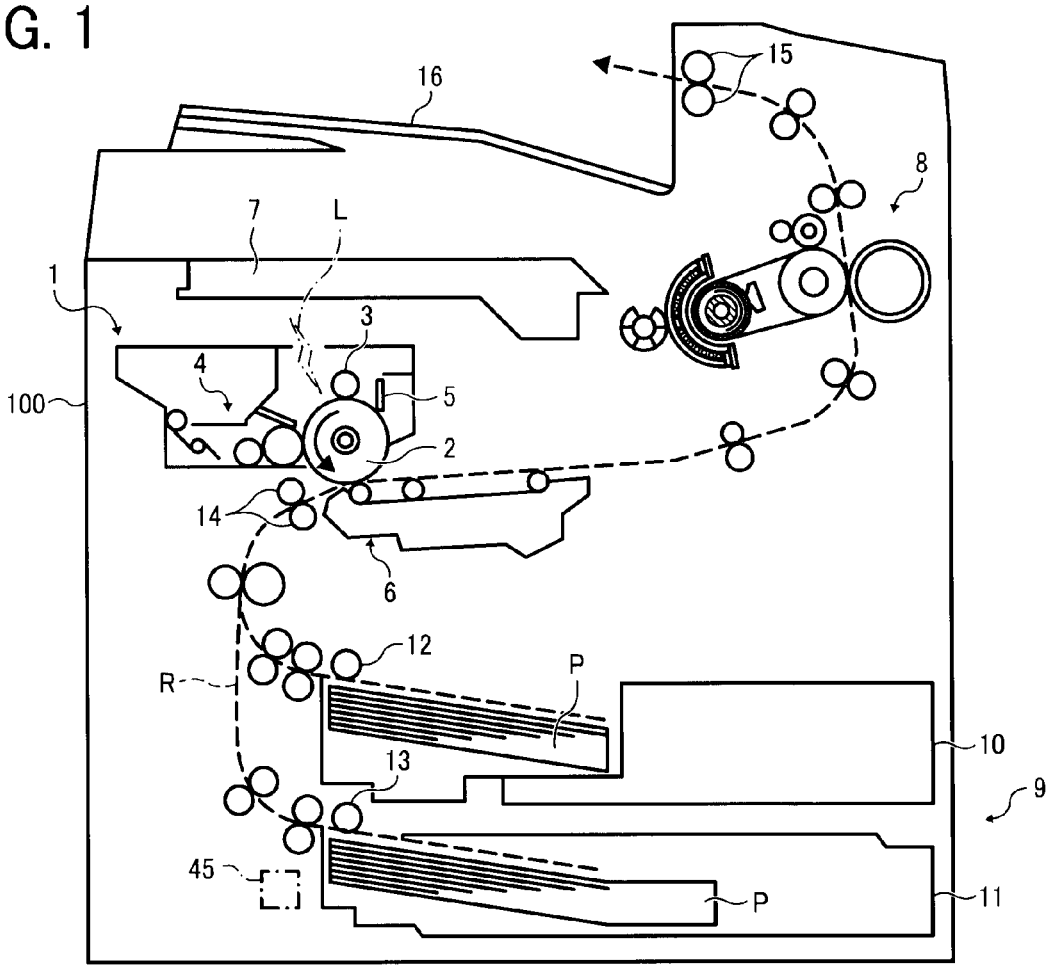
FIG. 1 is an overall schematic view illustrating a configuration of an image forming apparatus including a fixing device according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is a multicolor printer (hereinafter referred to as a printer) according to an illustrative embodiment of the present invention is described.

FIG. 1 is a schematic diagram illustrating a configuration of an image forming apparatus 100.

FIG. 1 shows a state in which a process unit 1 is removably installed in the image forming apparatus 100. The process unit 1, which serves as an image forming unit, includes a photoreceptor 2, a charging roller 3, a developing device 4, and a cleansing blade 5.

The photoreceptor 2 serves as a latent image carrier that carries an electrostatic latent image on its circumferential surface. The charging roller 3 serves as a charging member that electrically charges the outer circumferential surface of the photoreceptor 2. The developing device 4 supplies toner to the electrostatic latent image carried on the outer circumferential surface of the photoreceptor 2, thus forming a toner image. The cleaning blade 5 serves as a cleaning member that cleans the outer circumferential surface of the photoreceptor 2.

The image forming apparatus 100 further includes an exposure device 7, a transfer device 6, a fixing device 8, and a sheet feeder 9. The exposure device 7 forms an electrostatic latent image on the photoreceptor 2, and the transfer device 6 transfers the toner image from the photoreceptors 2 onto a sheet P of recording media such as paper. The fixing device 8 fixes the image transferred onto the sheet P thereon. The sheet feeder 9 feeds the recording media to the process unit 1.

The sheet feeder 9 includes cassettes 10 and 11, each capable of containing multiple sheet P, and feed rollers 12 and 13 that feed the sheets P from the cassette 10 or 11 through a sheet conveyance pathway R (indicated as a broken line) upward to a discharge tray 16. Further, a pair of registration rollers 14 is disposed upstream from the transfer device 6 on the sheet conveyance pathway R in a direction in which the sheet P is transported. A pair of discharge rollers 15 is disposed at an exit of the sheet conveyance pathway R.

Basic operations of the image forming apparatus 100 are described below with reference to FIG. 1.

Initially, the photoreceptor 2 is rotated in a direction indicated by an arrow shown in FIG. 1, and the charging device 3 uniformly charges the surface of the photoreceptor 2 to a high potential. Based on image data, the exposure device 7 emits a laser beam L onto the surface of the photoreceptor 2. As a result, the electric potential of the portion of the photoreceptor 2 irradiated by the laser beam L decreases, thus forming an electrostatic latent image on the photoreceptor 2. The developing device 4 then supplies electrostatically charged toner to the electrostatic latent image to form a toner image (visible image) on the surface of the photoreceptor 2.

The sheet P is conveyed from one of the cassettes 11 and 12 to the sheet conveyance pathway R by one of the feed rollers 12 and 13. The sheet P thus fed is once stopped by the registration rollers 14, which restart rotating to forward the sheet P to the transfer device 6, in an operation that is timed to coincide with (that is, is synchronized with) the arrival of the toner image formed on the photoreceptor 2.

Subsequently, the transfer device 6 transfers the toner image formed on the photoreceptor 2 onto the sheet P, after which the sheet P is transported to the fixing device 8. While the sheet P passes though the fixing device 8, the toner image is fixed on the sheet P with heat and pressure. Thereafter, the sheet P is discharged from the image forming apparatus 100 by the discharge rollers 15 and stacked on the discharge tray 16.

Further, after the transfer process, the cleaning blade 5 removes residual toner adhering to the surface of the photoreceptor 2, and an electrical discharge lamp, not shown, electrically discharges the surface of the photoreceptor 2 in preparation for the next image forming operation.

Next, a configuration of the fixing device 8 according to the present embodiment is described below.

Figure 2A:
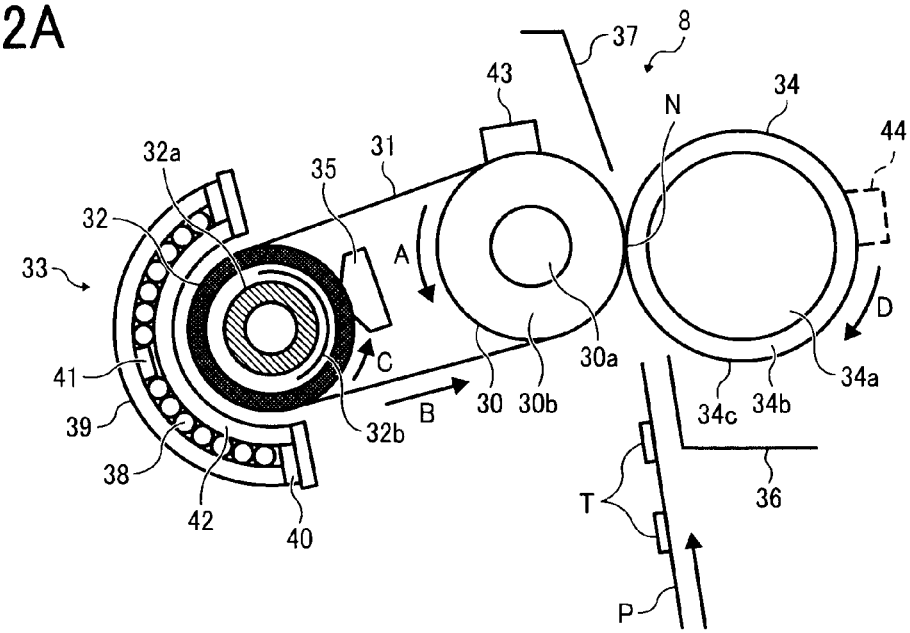
FIG. 2A is a schematic view illustrating a configuration of the fixing device shown in FIG. 1.

FIG. 2A is a schematic view illustrating the configuration of the fixing device 8. In FIG. 2A, a reference character T represents toner images formed on the sheet P.

In FIG. 2A, the fixing device 8 includes a fixing roller 30, a fixing belt 31, a heating roller 32, an induction heating unit 33, a pressure roller 34, a thermostat 35, a guide plate 36, and a separation plate 37. The fixing belt 31 serves as a fixing member and the pressure roller 34 serves as a pressing member. The fixing device 8 can increase temperature to a predetermined or given fixable temperature in a relatively short time period of from 20 seconds to 30 seconds, and the images are fixed on 20 to 30 sheets P in one minute in the fixing device 8.

The fixing roller 30 can have an outer diameter of within a range of from 30 mm to 50 mm and includes a metal core 30*a* and an elastic layer 30*b* that is located on the outer circumferential surface of the metal core 30*a*. The metal core 30*a* is made of aluminum, stainless steel (SUS), iron, or the like. The elastic layer 30*b* having a thickness of within a range of from 2 mm to 15 mm is made of an elastic material, such as foamed silicone rubber, that has a higher degree of thermal insulation. The fixing roller 30 is rotated counterclockwise in FIG. 2A by a driving mechanism, not shown.

Using the material such as foamed silicone rubber having a higher degree of thermal insulation for the elastic layer 30*b* can decrease thermal conductivity, and thus heat transfer from the fixing belt 31 can be prevented or reduced, thereby decreasing apparent thermal capacity.

The heating roller 32 is cylindrical member having an outer diameter of within a range of from 15 mm to 25 mm and a thickness of within a range of from 300 μm to 1000 μm. The heating roller 32 is made of non-magnetic material, such as SUS304 (stainless steel), and rotates counterclockwise in FIG. 2A.

The fixing device 8 further includes an internal core 32*a* disposed inside the heating roller 32 and a heating layer 32*b*. The internal core 32*a* is made of a material, such as, ferrite, having a higher magnetic permeability, and is disposed in a center portion of the heating roller 32. The heating layer 32*b* includes copper-plated stainless steel and is located between the internal core 32*a* and the fixing belt 31. In the configuration depicted in FIG. 2A, the heating layer 32*b* is disposed between the internal core 32*a* and the heating roller 32.

Eddy current is generated in the heating layer 32*b* by receiving an alternating magnetic field (described in detail below), thereby generating Joule heating (also known as resistive heating). Thus, the heating layer 32*b* heats the fixing belt 31 that is wound around the heating roller 32.

It is to be noted that the heating layer 32*b* is not limited to the copper-plated stainless steel. Alternatively, the heating layer 32*b* may be a magnetic metal material, such as, iron, cobalt, nickel, alloy including these metals, or poly-imido resin coated with a material, such as, copper, or aluminum, having a higher conductivity.

The internal core 32*a* that is a part of a core portion is disposed facing a coil unit 38 of the induction heating unit 33 via the fixing belt 31. In this embodiment, because the heating roller 32 is relatively thin while maintaining a certain strength, the heat capacity can be reduced, which allows the temperature of the heating roller 32 to increase to a desired value in a shorter time period.

In the fixing device 8, "a core portion" means both core portions facing each other that contribute to the electromagnetic induction heating. That is, the core portion of the fixing device 8 includes the core 39, the side core 40, and the center core 41 included in the induction heating unit 33, and the internal core 32*a* disposed inside the heating roller 32.

The fixing belt 31 is a seamless belt that has a width of within a range of from 50 mm to 80 mm. The fixing belt 31 is wound around and is supported by the heating roller 32 and the fixing roller 30. The fixing belt 31 is multilayered and includes an inner layer, an intermediate elastic layer, and a surface release layer, not shown in the drawing. The inner layer, which has a thickness of within a range of from 50 μm to 200 μm, is made of, for example, poly-imido. The elastic layer, which has a thickness of within a range of from 70 μm to 300 μm, is disposed on top of the inner layer and is made of, for example, silicone rubber. The release layer, which has a thickness of within a range of from 5 μm to 50 μm, is made of, for example, a fluoro-compound. Inclusion of the release layer facilitates release of the toner image T from the fixing belt 31.

The induction heating unit 33 includes the coil unit 38, a coil guide 42, and the core portion mentioned previously, which includes a core 39, a side core 40, and a center core 41.

Figure 3:
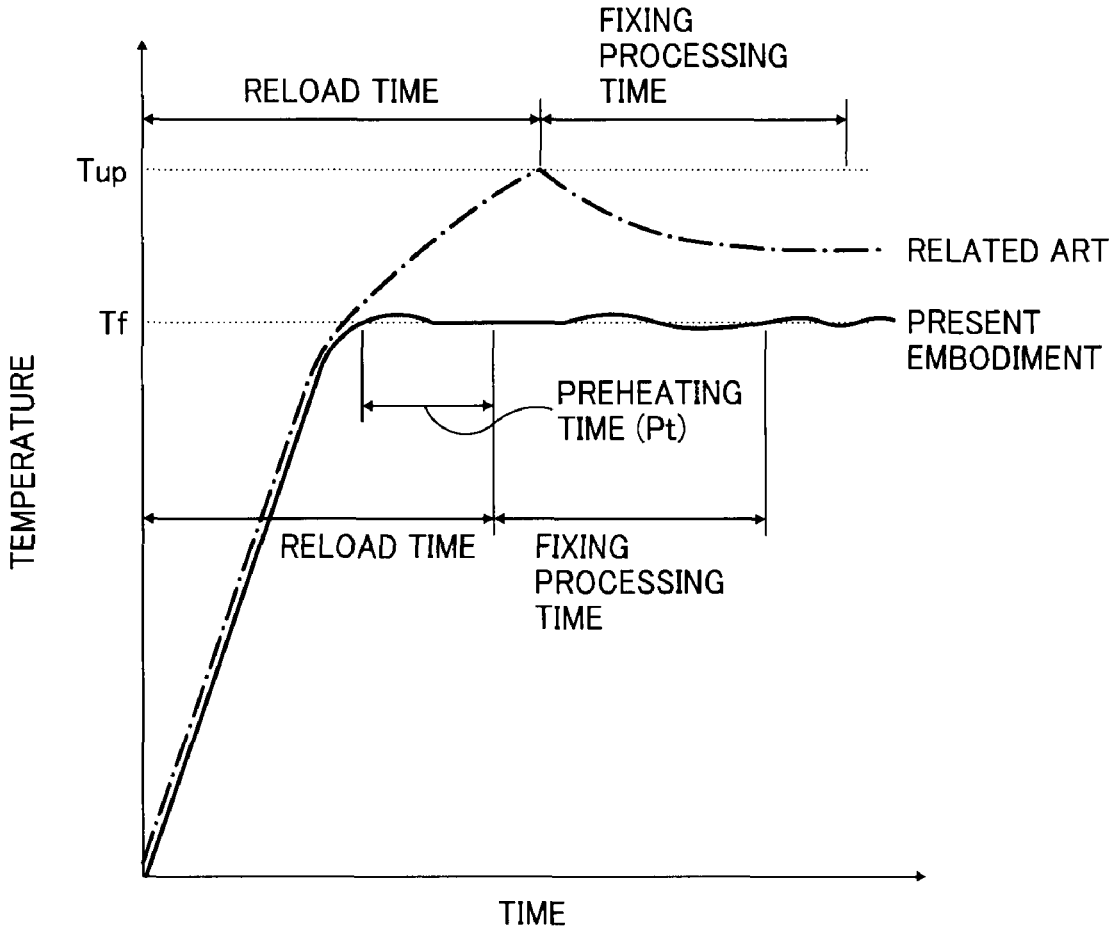
FIG. 3 is a graph illustrating changes in the temperature of a fixing belt included in the fixing device shown in FIG. 2A when a reload control is executed.

The coil unit 38 can be litz wire formed of multiple thin wires, extending in a width direction (perpendicular to the surface of the paper on which FIG. 3 is drawn) so that the coil unit 38 partly covers the fixing belt 31 that is wound around the heating roller 32.

The coil guide 42 is formed of a material such as resin metal that has higher heat resistivity and holds the coil unit 38, the core 39, the side core 40, and the center core 41. The core 39, the side core 40, and the center core 41 are respectively formed of a material such as ferrite that has a higher magnetic permeability.

The core 39 is disposed facing the coil unit 38 that extends in the width direction. The side core 40 is disposed in end portions on both sides of the coil unit 38. The center core 41 is disposed in a center portion of the coil unit 38, and the coil unit 38 is formed with the respective coiled litz wires arranged around the center core 41.

Providing the internal core 32*a* in the heating roller 32 can produce a favorable magnetic field between the core 39 and the internal core 32*a*, and the core portion can heat the heating roller 32 and the fixing belt 31 effectively. That is, the core portion in the developing device 8 functions as a heating mechanism to heat the fixing belt 31 (serving as a heating member).

The pressure roller 34 having an outer diameter of within a range of from 30 mm to 50 mm is formed of multiple layers including a metal core 34*a*, an intermediate elastic layer 34*b*, and a surface release layer 34*c*. The metal core 34*a* made of, for example, iron (Fe), aluminum (Al), or stainless steel (SUS) is located in a center portion of the pressure roller 34. The elastic layer 34*b* having a thickness of within a range of from 1 mm to 10 mm is made of, for example, fluoride rubber, or silicone rubber and is located on top of the metal core 34*a*. The release layer 34*c* having a thickness of within a range of from 5 μm to 50 μm is made of, for example, fluoride alloy.

A fixing nip N is formed at a position where the pressure roller 34 presses against the fixing roller 30 through the fixing belt 31.

The guide plate 36 that guides the sheet P is disposed at an entrance of the fixing nip N. The separation plate 37 that separate the sheet P from the fixing belt 31 is disposed at an exit of the fixing nip N.

The thermostat 35 is disposed to contact a part of the outer circumferential surface of the heating roller 32. When the temperature of the heating roller 32 detected by the thermostat 35 exceeds a predetermined temperature, the thermostat 35 stops conducting electricity to the induction heating unit 33, and thus the induction heating unit 33 stops heating the fixing belt 31.

Further, a thermistor 43 that functions as a temperature detector (fixing-member temperature detector) is disposed on the fixing belt 31. The temperature of the fixing belt 31 is controlled by directly measuring the temperature on the outer surface of the fixing belt 31 by the thermistor 43. It is to be noted that, as for the temperature detector, a thermopile that detects the temperature of the fixing belt contactlessly can be also used.

Figure 2B:
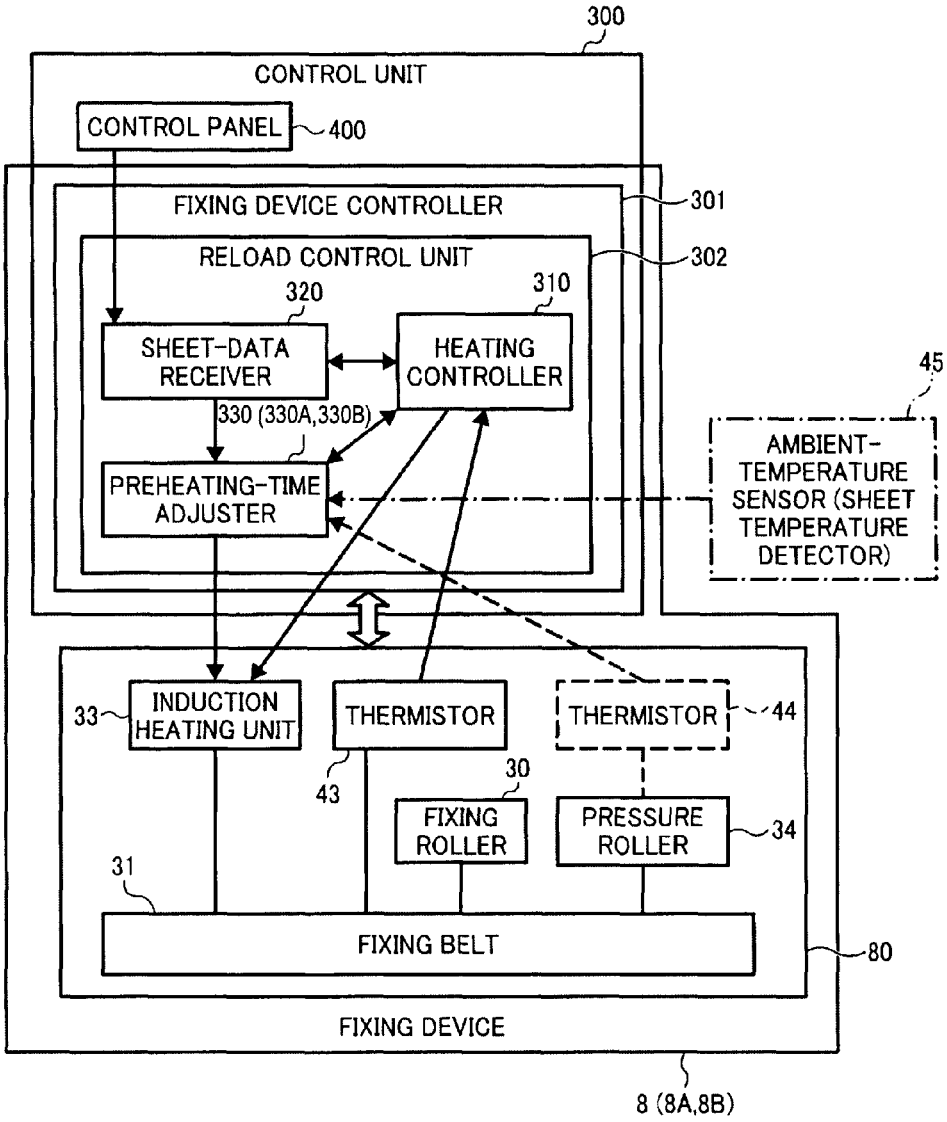
FIG. 2B is a block diagram illustrating a configuration of a control mechanism for the fixing device shown in FIG. 2A.

FIG. 2B is a block diagram illustrating a configuration of a control mechanism for the fixing device 8 included in the image forming apparatus 100 depicted in FIG. 1. A control unit 300 that controls entire operation of the image forming apparatus 100 includes a fixing-device controller 301. The fixing device controller 301 is included in the fixing device 8 and is operatively connected to a single assembly 80 in the fixing device 8. A reload control unit 302 in the fixing device controller 301 controls a reload process.

Operation of the fixing device 8 having the configuration described above is described below.

Initially, the reload control unit 302 starts the reload control. More specifically, in the reload control, a heating controller 310 instructs that the fixing belt 31 is heated to a predetermined temperature set in advance (hereinafter "fixing temperature"), and the fixing belt 31 becomes ready for the fixing process. As the fixing roller 30 rotates in a direction indicated by an arrow A shown in FIG. 2A, the fixing belt 31 rotates in a direction indicated by an arrow B shown in FIG. 2A, which causes the heating roller 32 to rotate counterclockwise indicated by an arrow C in FIG. 2A, and further, causes the pressure roller 34 to rotate in a direction indicated by an arrow D shown in FIG. 2A.

The fixing belt 31 is heated by the induction heating unit 33 that is active. That is, when an alternating current at high frequency flows to the coil unit 38, magnetic force lines are formed between the core 39 and the internal core 32*a* so that their direction alternates bidirectionally. In short, an alternating magnetic field is formed.

At this time, an eddy current is generated on a surface of the heating layer 32*b* inside the heating roller 32, and Joule heating caused by electric resistance of the heating layer 32*b* heats the fixing belt 31 that is wound around the heating roller 32.

Subsequently, the temperature of the fixing belt 31 is measured by the thermistor 43, and, based on the measured temperature, whether or not the temperature of the fixing belt 31 reaches the fixing temperature is determined.

When the temperature of the fixing belt 31 reaches the fixing temperature and thus the reload control is finished, the sheet P on which the toner image T is transferred is passed through the fixing nip N between the pressure roller 34 and fixing roller 30 by the fixing belt 31, and the toner image T on the sheet P is heated and fused at the fixing nip N.

More specifically, the sheet P on which the toner image T is transferred after image forming process is conveyed to the fixing nip N formed between the fixing belt 31 and the pressure roller 34, guided by the guide plate 36. Subsequently, the toner image T is fixed on the sheet P by receiving the heat from the fixing belt 31 and the pressure from the pressure roller 34, after which, the sheet P is discharged from the fixing nip N formed between the fixing belt 31 and the pressure roller 34.

First Embodiment

Next, behavior and effect of the fixing device 8 according to a first embodiment is described below.

FIG. 3 is a graph illustrating changes in the temperature of the fixing belt 31 when the reload control is executed. In FIG. 3, a solid line indicates temperature changes in the reload control according to the present embodiment, and a broken line indicates temperature changes in reload control according to a comparative example.

In the reload control according to the comparative example depicted in FIG. 3, the fixing process is started after the fixing belt 31 is heated to a predetermined temperature Tup that is higher than a predetermined fixing temperature Tf, in consideration of the decrease in the temperature in continuous fixing.

By contrast, in the reload control according to the present embodiment, the heating controller 310 controls the induction heating unit 33 such that the heating the fixing belt 31 is heated to the fixing temperature Tf, and following that, the fixing belt 31 is preheated to store heat in the fixing device 8 while maintaining the fixing temperature Tf (a preheating process) before the fixing process is started.

With reference to FIG. 2B, the reload control unit 302 is included in the fixing device controller 301 that is included in the fixing device 8. The reload control unit 302 includes the heating controller 310, a sheet-data receiver 320, and a preheating-time adjuster 330. Both of the sheet-data receiver 320 and the preheating-time adjuster 330 are communicably connected to the heating controller 310).

The sheet-data receiver 320 (recording-medium data receiver) acquires data on the sheet P before the fixing process. The preheating-time adjuster 330 changes a preheating time (Pt) during which the preheating is executed based on the sheet data acquired by the sheet-data receiver 320.

As for the preheating-time adjuster 330, for example, a control device that controls power supply to the induction heating unit 33 is used. The sheet-data receiver 320 can be formed with a sensor (not shown) that detects sheet size, or a device that acquires data such as the type of sheet or the number of sheets output in a continuous fixing process (hereinafter "sheet number in continuous fixing) inputted by users through a control panel 80 or the like.

Figure 4:
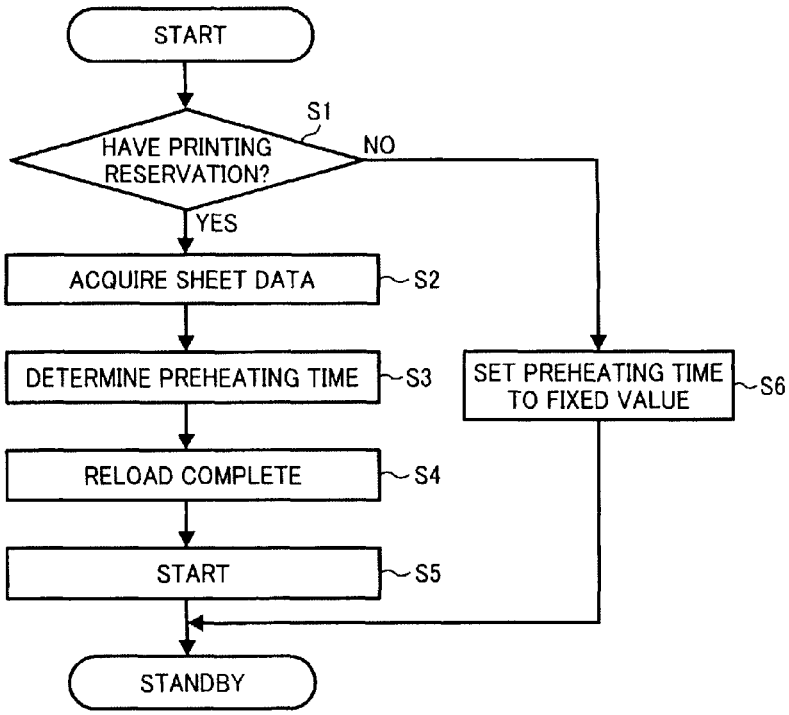
FIG. 4 is a flowchart illustrating steps in an operation of the fixing device according to the present embodiment.

FIG. 4 is a flowchart illustrating steps in an operation of the fixing device 8 according to the present embodiment. As shown in FIG. 4, the operational process regarding the fixing device 8 including the reload control and the fixing process is described below.

Initially, when the image forming apparatus 100 is turned on, or when the image forming apparatus 100 is reactivated from a standby mode, the reload control of the fixing device 8 is initiated. More specifically, as described above, initially, when the fixing roller 30 is rotated, simultaneously, the induction heating unit 33 is heated. Subsequently, at step S1, the sheet-data receiver 320 determines whether or not a printing job is reserved.

At this time, at step S2, when the printing is reserved (Yes at step S1), the sheet-data receiver 320 acquires data on the number of sheets, sheet type, and sheet size.

After that, at step S3, the preheating-time adjuster 330 determines the preheating time (Pt) based on the data acquired by the sheet-data receiver 320 and "preheating-time calculation tables" shown in TABLES 1A, 1B, and 1C. It is to be noted that that the three tables shown below are linked and used cumulatively, that is, the results of TABLE 1A are used as inputs in TABLE 1B, and the results from table 1B are used as inputs for TABLE 1C.

TABLE 1A

| SHEET SIZE | NUMBER OF SHEETS |
|---|---|
| A4 or SMALLER THAN A4 | ×1 |
| LARGER THAN A4 | ×2 |

TABLE 1B

| NUMBER OF SHEETS | PREHEATING TIME(SEC) |
|---|---|
| 5 OR LESS THAN 5 | +5 |
| 6 TO 10 | +10 |
| MORE THAN 10 | +20 |

TABLE 1C

| SHEET TYPE | PREHEATING TIME(SEC) |
|---|---|
| PLAIN PAPER | 0 |
| MEDIUM THICKNESS PAPER | +5 |
| CARDBOARD | +10 |

TABLE 1A shows a calculation table of the number of sheets based on sheet size. TABLE 1B shows a calculation table of the preheating time based on the number of sheets. TABLE 1C shows a calculation table of the preheating time based on sheet type.

More specifically, in TABLE 1A, when the sheet size is A4 or smaller than A4, as the number of sheets, an actual number of sheet acquired by the sheet-data receiver 320 is used. When the sheet size is larger than A4, the number of sheets is twice the actual number of sheets acquired by the sheet-data receiver 320.

In TABLE 1B, when the number of sheets is equal to or less than 5, the preheating time is set to 5 seconds, when the number of sheets is between 5 and 10, the preheating time is set to 10 seconds, and when the number of sheets is more than 10, the preheating time is set to 20 seconds.

In TABLE 1C, when plain paper is used for imaging, no additional preheating time is added to the preheating time acquired by TABLE 1B. However, when a medium-thickness paper is used for printing, an additional preheating time of 5 seconds is added to the preheating time acquired by TABLE 1B, and when cardboard is used for printing, an additional preheating time of 10 seconds is added thereto.

For instance, when three pieces of A3-size plain paper are continuously outputted, because the sheet size is A3, the number of sheets is multiplied by 2 (3×2=6) based on TABLE 1A. Subsequently, because the calculated number of sheets is 6, the preheating time is set to 10 seconds based on TABLE 1B. Additionally, because plain paper is used, no additional preheating time based on the sheet type on TABLE 1C is added to the preheating time based on TABLE 1B. Therefore, the preheating time is set to 10 seconds.

Then, after the temperature of the fixing belt 31 reaches the fixing temperature (Tf), the fixing belt 31 is further preheated for 10 seconds, in this instance by heating the induction heating unit 33 while the fixing roller 30 is rotated, and the reload control is finished at step S4. Subsequently, at step S5, the reserved printing job is started. After the printing process is finished, the fixing device 8 enters or re-enters the standby mode.

By contrast, at step S1, when the sheet-data receiver 320 determines that the printing is not reserved (NO at step S1), at step S6 the preheating time is set to a fixed given value (20 seconds in the present embodiment) that is estimated in advance. Then, after the fixing device 8 is preheated for the time period thus set, the fixing device 8 enters the standby mode.

As shown in TABLES 1A, 1B, and 1C, in the fixing device 8 according to the present embodiment, when the number of sheets is larger, when the sheet size is larger, and when the sheet is thicker, heat storage is increased by increasing the preheating time because in these cases the fixing belt 31 is deprived of a greater amount of heat in the fixing process. Herein, "amount of heat storage" means the amount of heat stored in the fixing belt 31, the pressure roller 34, and the members disposed adjacent to them. As a result, the reduction in temperature can be prevented even when a larger number of sheets are printed continuously, and therefore fixing failures can be reduced.

Further, as shown in FIG. 3, differently from the comparative example, because the fixing device according to the present embodiment can execute the reload control at a substantially constant temperature from the initial sheet to the final sheet in the continuous printing, fixing failures, such as unevenness in image gloss or unevenness in the amount by which sheets curl (hereinafter "curl amount"), can be prevented.

By contrast, when the number of sheets is smaller, the amount of deprived heat in the fixing process is smaller, and therefore, the preheating time can be shortened, which in turn can shorten the reload time.

Second Embodiment

Next, a fixing device 8A according to a second embodiment is described below.

The fixing device 8A has the same basic operation and configuration as the fixing device 8 of the first embodiment described above, but with the addition of a pressing member temperature detector. That is, the basic operation of the fixing device 8A is similar to the operational process in the flowchart shown in FIG. 4 and moreover has the same components as the components of the fixing device 8 (other than the pressing member temperature detector difference described above) which are represented by identical reference numerals, and therefore a description thereof is omitted for simplicity.

More specifically, the fixing device 8A includes a thermistor 44, represented by a dashed square depicted in FIGS. 2A and 2B, functioning as the pressing member temperature detector disposed in contact with a part of the outer circumferential surface of the pressure roller 34. Alternatively, as for the pressing member temperature detector, a thermopile that detects the temperature contactlessly can be used.

When the fixing device 8A executes a reload control, a preheating-time adjuster 330A determines a preheating time (Pt) based on the data acquired by the sheet-data receiver 320 and "preheating-time calculation table" shown in TABLES 2A through 2D. In this embodiment, "a temperature of the pressure roller 34" detected by the thermistor 44 is added as an element in the preheating-time calculation table as TABLE 2D. TABLE 2D shows a calculation table of the preheating time based on the temperature of the pressure roller 34.

In TABLE 2D, when the temperature of the pressure roller 34 is lower than 30° C., the preheating time is not changed. However, when the temperature of pressure roller 34 is within a range of from 30° C. to 60° C., the preheating time is reduced by 3 seconds from the preheating time calculated based on TABLE 2A, 2B, and 2C. When the temperature of the pressure roller 34 is higher than 60° C., the preheating time is reduced by 10 seconds from the preheating time calculated based on TABLE 2A, 2B, and 2C.

It is to be noted that the TABLE 2A, 2B, and 2C are identical to the TABLE 1A, 1B, and 1C, respectively.

That is, the preheating-time adjuster 330A in the fixing device 8A according to the present embodiment changes the preheating time (Pt) based on the temperature of the pressing member detected by the pressing-member temperature detector (e.g., thermistor 44) shown in TABLE 2D in addition to the sheet data acquired by the sheet-data receiver 320 shown in TABLE 2A, 2B, and 2C.

TABLE 2A

| SHEET SIZE | NUMBER OF SHEETS |
|---|---|
| A4 or SMALLER THAN A4 | ×1 |
| LARGER THAN A4 | ×2 |

TABLE 2B

| NUMBER OF SHEETS | PREHEATING TIME(SEC) |
|---|---|
| 5 OR LESS THAN 5 | +5 |
| 6 TO 10 | +10 |
| MORE THAN 10 | +20 |

TABLE 2C

| SHEET TYPE | PREHEATING TIME(SEC) |
|---|---|
| PLAIN PAPER | 0 |
| MEDIUM THICKNESS PAPER | +5 |
| CARDBOARD | +10 |

TABLE 2D

| TEMPERATURE OF PRESSURE ROLLER | PREHEATING TIME(SEC) |
|---|---|
| LOWER THAN 30° C. | 0 |
| 30° C. TO 60° C. | −3 |
| OVER 60° C. | −10 |

Next, the calculation method of the preheating time based on TABLE 2A, 2B, 2C, and 2D is described below using specific examples.

For instance, it is assumed that three sheets of A3-size plain paper are continuously outputted, and the temperature of the pressure roller 34 is 50° C. In this case, because the sheet size is A3, the number of sheets is multiplied by 2 (3×2=6) based on TABLE 2A. Then, because the calculated number of sheets is 6, the preheating time is set to 10 seconds based on TABLE 2B. Subsequently, because plain paper is used, the additional preheating time based on the sheet type on TABLE 2C is not added.

Then, because the temperature of the pressure roller 34 is 50° C., regarding the preheating time, for example, 3 seconds is subtracted from the preheating time calculated above. Therefore, in this instance, the preheating time (Pt) is determined to be 7 seconds (10−3=7).

As another case, it is assumed that two sheets of A4-size plain paper are continuously outputted, and the temperature of the pressure roller 34 is 80° C.

In this case, because the sheet size is A4, the number of sheets is calculated as the actual number, 2. Then, since the calculated number of sheets is 2, the preheating time is set to 5 seconds based on TABLE 2B. Subsequently, because plain paper is used, no additional preheating time based on the sheet type on TABLE 2C is added the preheating time based on TABLE 2B.

Further, because the temperature of the pressure roller 34 is 80° C., for example, 10 seconds is subtracted from the preheating time (5−10=−5). However, when the calculated preheating time is less than 0 seconds, the preheating time is determined to be 0 seconds.

Then, the preheating is executed for the time period thus set, after which the reload control is finished in the fixing device 8A according to the present embodiment.

It is to be noted that the basic operation of the fixing device 8A is similar to the operational process in the flow chart shown in FIG. 4. Additionally, because the fixing device 8A has components similar to the components of the fixing device 8, other than the difference described above, which are represented by identical reference numerals, and the description thereof is omitted for simplicity.

In the fixing device 8A according to the second embodiment, similarly to the first embodiment, when the fixing belt is deprived of a greater amount of heat in the fixing process, the heat storage is increased by increasing the preheating time, and therefore fixing failures can be prevented.

Further, the present embodiment has an additional advantage in that, when a relatively short time period has elapsed after the fixing device 8A enters the standby mode, a certain amount of heat remains stored in the fixing device 8A, and thus the preheating time in the reload control can be reduced.

Therefore, in the present embodiment, by measuring the temperature of the pressure roller 34 in the fixing device 8A in addition to acquiring the sheet data as described above, the amount of heat stored in the fixing device can be ascertained more precisely, enabling finer, more precise reload control.

Accordingly, when the temperature of the pressure roller is higher, that is, it is determined that a certain amount of heat is stored in the fixing device, the preheating time can be shortened, which can shorten the reload time.

Third Embodiment

Next, a fixing device 8B according to a third embodiment is described below. It is to be noted, that the basic operation of fixing device 8B is similar to the operational process in the flow chart shown in FIG. 4. Additionally, other than the difference described below the fixing device 8B has components similar to the component of the fixing device 8A which are represented by identical reference numerals, and therefore a description thereof is omitted for simplicity.

The fixing device 8B includes the pressing member temperature detector similarly to the second embodiment. However, additionally, the fixing device 8B includes an ambient-temperature detector that detects the ambient temperature of the environmental around the sheet. As for the ambient-temperature detector, an ambient-temperature sensor 45 that is disposed closer to the sheet cassette 11, represented as an alternate long and short dashed square depicted in FIGS. 1 and 2B, can be used. The ambient-temperature sensor 45 detects the ambient temperature contained in the sheet cassettes 11 and 12.

When the fixing device 8B executes reload control, a preheating-time adjuster 330B determines a preheating time (Pt) based on the data acquired by the sheet-data receiver 320 and "preheating-time calculation table" shown in TABLES 3A through 3E. In this embodiment, "environmental temperature of the sheets" detected by the ambient-temperature sensor 45 is added as an element in the preheating-time calculation table as TABLE 3E. TABLE 3E shows a calculation table of the preheating time based on the temperature of environmental around the sheets (Hereinafter "ambient temperature").

More specifically, as shown in TABLE 3E, when the ambient temperature is lower than 15° C., the preheating time is increased by 3 seconds, for example. When the ambient temperature is within a range of from 15° C. to 30° C., the preheating time is not changed.

When the ambient temperature is over 30° C., the preheating time is reduced by 3 seconds from the preheating time calculated based on TABLE 3A through 3D.

That is, the preheating-time adjuster 330B in the fixing device 8B according to the present embodiment changes the preheating time (Pt) based on the ambient temperature acquired by the ambient-temperature detector (e.g., ambient-temperature sensor 45) in addition to the temperature of the pressing member detected by the pressing member temperature detector (e.g., thermistor 44) shown in TABLE 3D and the sheet data acquired by the sheet-data receiver 320 shown in TABLE 3A, 3B, and 3C.

TABLE 3A

| SHEET SIZE | NUMBER OF SHEETS |
|---|---|
| A4 or SMALLER THAN A4 | ×1 |
| LARGER THAN A4 | ×2 |

TABLE 3B

| NUMBER OF SHEETS | PREHEATING TIME(SEC) |
|---|---|
| 5 OR LESS THAN 5 | +5 |
| 6 TO 10 | +10 |
| MORE THAN 10 | +20 |

TABLE 3C

| SHEET TYPE | PREHEATING TIME(SEC) |
|---|---|
| PLAIN PAPER | 0 |
| MEDIUM THICKNESS PAPER | +5 |
| CARDBOARD | +10 |

TABLE 3D

| TEMPERATURE OF PRESSURE ROLLER | PREHEATING TTME(SEC) |
|---|---|
| LOWER THAN 30° C. | 0 |
| 30° C. TO 60° C. | −3 |
| OVER 60° C. | −10 |

TABLE 3E

| AMBIENT TEMPERATURE | PREHEATING TIME(SEC) |
|---|---|
| LOWER THAN 15° C. | +3 |
| 15° C. TO 30° C. | 0 |
| OVER 30° C. | −3 |

Next, a calculation method of the preheating time based on TABLES 3A through 3E is described below, using specific examples.

For instance, it is assumed that three sheets of A4-sized plain paper are continuously outputted, the temperature of the pressure roller is 25° C., and the ambient temperature is 13° C. In this case, because the sheet size is A3, the number of sheets is calculated as the actual number, 3, based on TABLE 3A.

Then, because the calculated number of sheets is 3, the preheating time is set to 5 seconds based on TABLE 3B. Subsequently, because plain paper is used, no additional preheating time based on the sheet type on TABLE 3C is added. Then, at this time, because the temperature of the pressure roller 34 is 25° C., no preheating time based on TABLE 3D is added.

However, because the ambient temperature is 13° C., the preheating time (Pt) of 3 seconds is added to the preheating time acquired by TABLE 3E. Accordingly, in this case, the heating time is determined to be 8 seconds (5+3=8).

Then, the preheating is executed for the time period thus set, after which the reload control is finished in the fixing device 8B according to the present embodiment.

In the fixing device 8B according to the third embodiment, similarly to the first and second embodiments, when the fixing belt is deprived of a greater amount of heat in the fixing process, the heat storage is increased by increasing the preheating time, and therefore fixing failures can be prevented.

Further, similarly to the second embodiment, by measuring the temperature of the pressure roller 34 in fixing device 8B in addition to acquiring the sheet data, the amount of heat stored in the fixing device can be ascertained. Accordingly, when it can be ascertained that the heat storage is a predetermined amount, the preheating time is set to shorten, which can shorten the reload time.

An additional advantage of the present embodiment is described below.

In general, the amount of heat of which the fixing belt 31 is deprived by the recording media in the fixing process depends on the temperature of the recording media (sheets). When the sheet temperature is higher, the fixing belt is deprived of a smaller amount of heat in the fixing process, and thus, the preheating time can be shortened. By contrast, when the sheet temperature is lower, the fixing belt is deprived of a greater amount of heat in the fixing process, and thus, a relatively long time is required for the reload.

Therefore, the fixing device 8B according to the present embodiment estimates the sheet temperature by detecting the temperature around the sheet, and the preheating time is set based on the detected environmental temperature. Accordingly, the amount of heat stored in the fixing device can be made more suitable for the fixing conditions, which can enhance fixing performance further and shorten the reload time.

It is to be noted that, in an image forming apparatus including the fixing device 8B according to the present embodiment, instead of using the above-described ambient-temperature detector, a sheet temperature detector (recording-medium temperature detector) that directly measures the sheet temperature can be used. Additionally, the heating time may be determined based on TABLES 3A, 3B, 3C, and 3E calculated only based on the sheet data acquired by the sheet-data receiver 320 and the temperature around sheet detected by the ambient-temperature sensor 45.

Further, the preheating time can be changed based on at least one of the sheet type, sheet size, sheet weight, temperature of the heating roller, the temperature of the pressure roller, environmental temperature of the sheet, and sheet temperature.

As described above, in the various embodiments described above, because the preheating time is changed based on the sheet data or the like, the fixing device can store heat in accordance with the amount of heat consumed in the fixing process. When a greater amount of heat is consumed in the fixing process, the temperature reduction of the fixing member in the fixing process can be reduced by increasing the heat storage, which can prevent or inhibit the fixing failure.

Furthermore, in the various embodiments described above, the fixing device changes not a setting temperature of the fixing member as in the comparative example but the amount of heat storage while maintaining the temperature of the fixing member constant at the predetermined fixing temperature. Therefore, fixing failures such as unevenness in image gloss or unevenness in curl amount of the paper can be prevented. By contrast, when the amount of heat consumption is smaller, the preheating time can be shortened, which can shorten the reload time.

(Multicolor Image Forming Apparatus)

Figure 5:
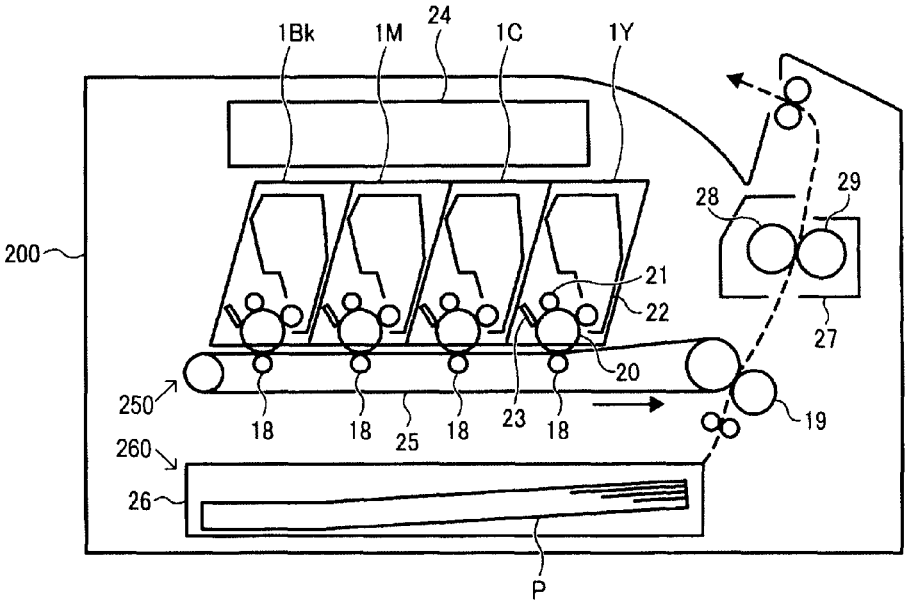
FIG. 5 is a schematic diagram illustrating a configuration of a multicolor image forming apparatus including any one of the fixing devices according to the above-described embodiments.

Herein, the fixing devices 8, 8A, and 8B according to the above-described first through third embodiments can be also used in multicolor image forming apparatuses such as a multicolor image forming apparatus 200 depicted in FIG. 5.

FIG. 5 is a schematic diagram illustrating a configuration of the multicolor image forming apparatus 200, including any one of the fixing devices according to the above-described embodiments. In FIG. 5, the multicolor image forming apparatus 200 includes four process units 1Y, 1C, 1M, and 1Bk as image forming units for forming respective single-color images corresponding to yellow, cyan, magenta, and black toner. The process units 1Y, 1C, 1M, and 1Bk are removably instable to the image forming apparatus 200.

Each of the process unit 1Y, 1C, 1M, and 1Bk includes a photoreceptor 20 that serves as image carriers, a charging roller 21 that serves as a charging device and electrically charges the outer circumferential surfaces of the respective photoreceptors 20, a developing device 22 that serves as cleaning member that clean the outer circumferential surfaces of the respective photoreceptors 20, and a cleaning blade 23 that serves as cleaning member and cleans the outer circumferential surfaces of the respective photoreceptors 20. The image forming apparatus 200 further includes an exposure device 24, a transfer device 250, a sheet feeder 260, and a fixing device 27. The exposure device 24, which includes laser light sources, exposes the outer circumferential surfaces of the respective photoreceptors 20. The sheet feeder 260 includes a sheet cassette 26 capable of containing multiple sheets P. In the transfer device 250, four primary transfer rollers 18 (serving as primary transfer members) and a secondary transfer roller 19 (serving as a secondary transfer member) are located inside an intermediate transfer belt 25.

The fixing device 27 includes a fixing roller 28 (serving as a fixing member) that presses against a pressure roller 29 (serving as a pressing member).

The fixing device 27 cans also execute the reload control according to any of the above-described embodiments.

Next, basic operation of the image forming apparatus 200 is described below.

When the image forming operation is started, the photoreceptors 20 in the respective process unit 1Y, 1M, 1C, and 1Bk are rotated clockwise in FIG. 5, by a driving device (not shown), and the outer circumferential surface of each photoreceptor 20 is uniformly charged by the charging roller 21 at a predetermined polarity.

The laser light sources in the exposure device 24 irradiate the outer circumferential surfaces of the respective photoreceptors 20, and latent images are formed thereon.

At this time, image data according to which the respective photoreceptors 20 are exposed consists of image data of single colors yellow, cyan, magenta, and black, decomposed from a multicolor image. The latent image formed on the photoreceptor 20 is rendered visible as a toner image by supplying toner from the respective developing device 22.

Then, the intermediate transfer belt 25 is rotated in a direction indicated by an arrow in FIG. 5, and the respective single-color images are transferred from the photoreceptors 20 and are superimposed one on another on the intermediate transfer belt 25 at positions facing the primary transfer rollers 18. Thus, the intermediate transfer belt 25 carries a single multicolor toner image on its surface.

Further, timed to coincidence with movement of the toner image on the intermediate transfer belt 25, the sheet P is fed from the cassette 26. Subsequently, the toner image is transferred onto the sheet P in a portion facing the secondary transfer roller 19 at once.

The sheet P onto which the toner image is transferred is conveyed to the fixing device 27, after which, the toner image is fixed on the sheet P with heat and pressure exerted by the fixing roller 28 and the pressure roller 29 in the fixing device 27. The sheet P on which the toner image is fixed is discharged outside to a stack portion (not shown).

Although the above description concerns a multicolor image forming process, the image forming apparatus 100 can form single-color images using one of four process unit 1Y, 1C, 1M, and 1Bk, or two or three color images using two or three of them.

(Variations)

A fixing device that executes the above-described reload control is not limited to the configuration described above. The reload control described above can be applied to, for instance, fixing devices depicted with references to FIGS. 6 through 10.

(Variation 1)

Figure 6:
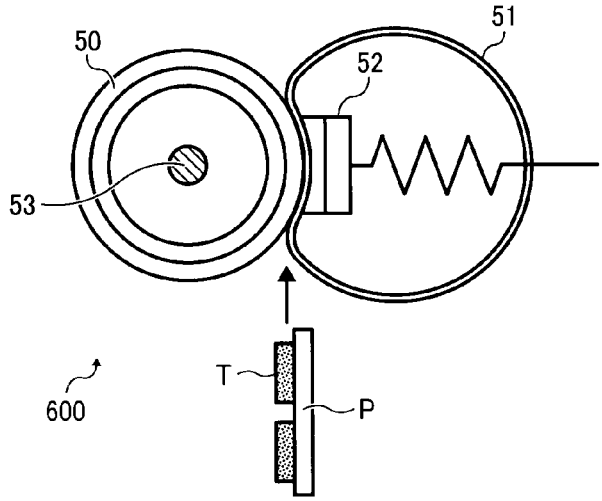
FIG. 6 is a schematic view illustrating a configuration of a fixing device including a fixing roller and a pressure belt.

A fixing device 600 depicted in FIG. 6 includes a fixing roller 50, a pressure belt 51, a pressure pad 52, and a heater 53. The fixing roller 50 serves as a fixing member. The heater 53 serves as a heating member to heat the fixing roller 50. The pressure belt 51 serves as a pressing member and is a seamless belt.

The pressure pad 52 causes the pressure belt 31 to press against the fixing roller 50 with a predetermined pressure.

During operation of the fixing device 600, the heater 53 heats the fixing roller 50 according to the above-described reload control. After the reload control is finished, the sheet P on which an unfixed toner image T is formed passes through a pressure portion (a fixing nip) formed between the fixing roller 50 and the pressure roller 51, and thus the toner image T is fixed on the sheet P with heat and pressure.

(Variation 2)

Figure 7:
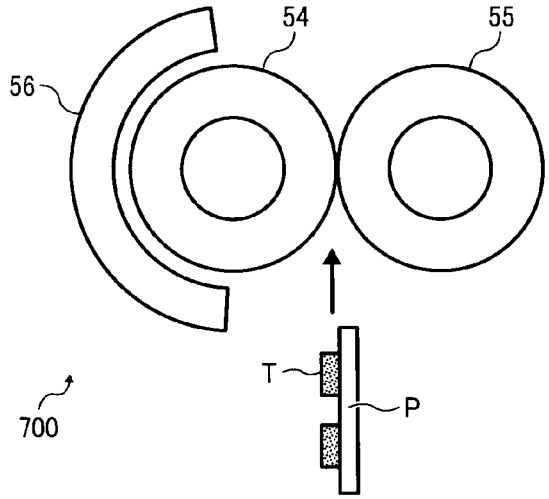
FIG. 7 is a schematic view illustrating a configuration of a fixing device including a fixing roller, a pressure roller, and an induction heating unit serving as a heating member.

A fixing device 700 depicted in FIG. 7 includes a fixing roller 54 serving as a fixing member, an induction heating member (IH coil) 56 serving as a heating member to heat the fixing roller 54, and a pressure roller 55 serving as a pressing member.

During operation of the fixing device 700, the induction heating member 56 is activated to heat the fixing roller 54 according to the above-described reload control. After the reload control is finished, the sheet P on which an unfixed toner image T is formed passes through a pressure portion (a fixing nip) formed between the fixing roller 54 and the pressure roller 55, and thus the toner image T is fixed on the sheet P with heat and pressure.

(Variation 3)

Figure 8:
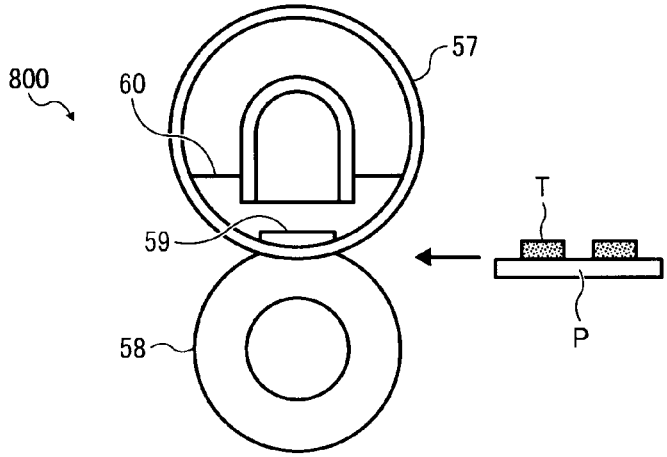
FIG. 8 is a schematic view illustrating a configuration of a fixing device including a flexible fixing sleeve and a pressure roller.

A fixing device 800 depicted in FIG. 8 includes a fixing sleeve 57 serving as a fixing member, a heater 59, a heater holder 60, and a pressure roller 58 serving as a pressing member. The fixing sleeve 57 is a flexible seamless belt. The heater 59 serves as a heating member to heat the fixing sleeve 57. The heater holder 60 holds the heater 59.

During operation of the fixing device 800, the heater 59 heats the fixing sleeve 57 as according to the above-described reload control. After the reload control is finished, the sheet P on which an unfixed toner image T is formed passes through a pressure portion (a fixing nip) formed between the fixing sleeve 57 and the pressure roller 58, and thus the toner image T is fixed on the sheet P with heat and pressure.

(Variation 4)

Figure 9:
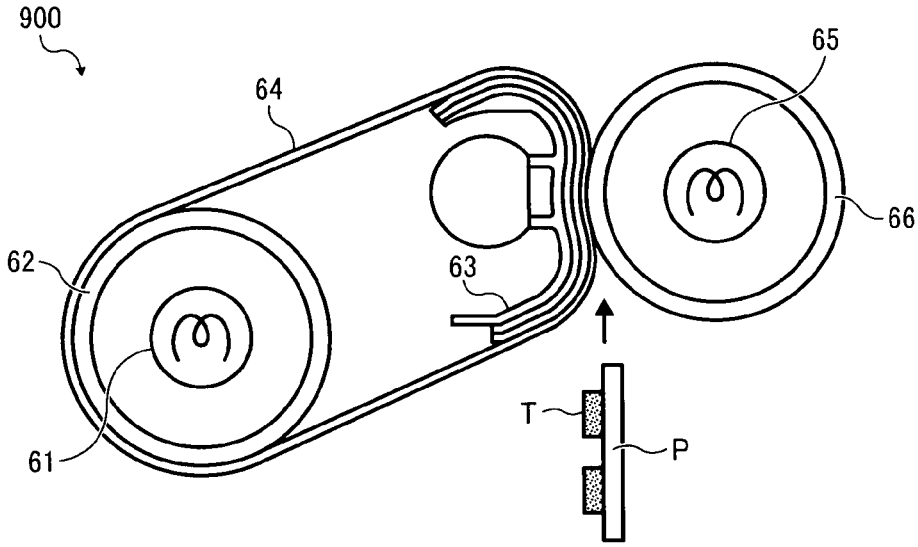
FIG. 9 is a schematic view illustrating a configuration of a fixing device including a fixing belt and a pressure roller.

A fixing device 900 depicted in FIG. 9 includes a heating roller 62 serving as a heating member, a fixing pad 63, a fixing belt 64, and a pressure roller 66 serving as a pressing member. The heating roller 62 includes a heater 61, and the pressure roller 66 includes a heater 65. The fixing belt 64 is wound around the fixing pad 63 and the heating roller 62. The pressure roller 66 that is disposed facing the fixing pad 63 presses against the fixing belt 64 with a predetermined pressure.

During operation of the fixing device 900, initially, the two heaters 61 and 65 heat respectively the fixing belt 64 and the pressure belt 66 according to the above-described reload control. After the reload control is finished, the sheet P on which an unfixed toner image T is formed passes through a pressure portion (a fixing nip) formed between the fixing belt 64 and the pressure roller 66, and thus the toner image T is fixed on the sheet P with heat and pressure.

(Variation 5)

Figure 10:
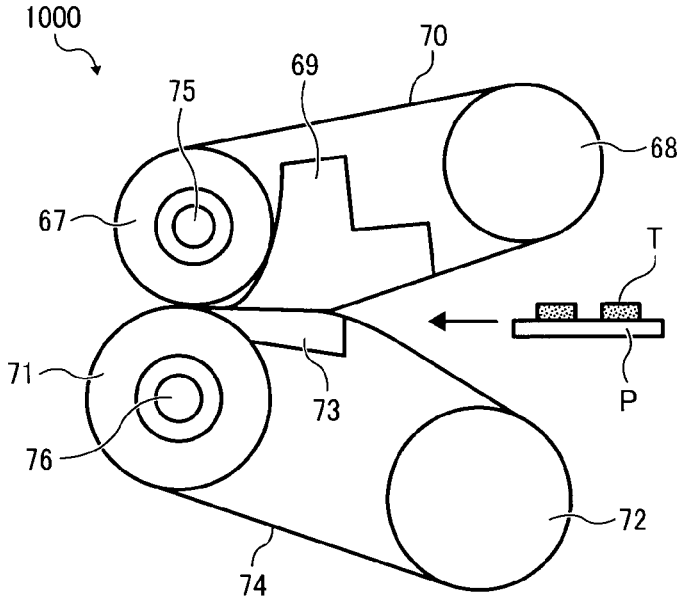
FIG. 10 is a schematic view illustrating a configuration of a fixing device including a fixing belt and a pressure belt.

A fixing device 1000 depicted in FIG. 10 includes a fixing belt 70 serving as a fixing member that is wound around multiple rollers 67 and 68 and a guide member 69, and a pressure belt 74 serving as a pressing member that is wound around multiple rollers 71 and 72 and a guide member 73. The pressure roller 74 is pressed against the fixing belt 70 with a predetermined pressure by the roller 71. The roller 67 includes a heater 75 and the roller 71 includes a heater 76, both serving as heating members.

During operation of the fixing device 1000, the two heaters 75 and 76 heat in the reload control and heats respective the fixing belt 70 and the pressure belt 74, as the above-described reload control. After the reload control is finished, the sheet P on which an unfixed toner image T is formed passes through a pressure portion (a fixing nip) formed between the fixing belt 70 and the pressure belt 74, and thus the toner image T is fixed on the sheet P with heat and pressure.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a fixing member;

a heating member to heat the fixing member;

a pressing member to press against the fixing member with a predetermined pressure, forming a nip where an image is fixed on a recording medium with heat and pressure;

a heating controller to cause the heating member to heat the fixing member to a predetermined temperature set in advance and to preheat the fixing member while maintaining the temperature of the fixing member;

a recording-medium data receiver to acquire recording-medium data before a fixing process is started; and a preheating-time adjuster to adjust a preheating time during which the heating member preheats the fixing member based on the data acquired by the recording-medium data receiver, wherein the recording-medium data includes at least a recording-medium type, a recording-medium size, and a number of recording media outputted continuously, and wherein the preheating time includes a first preheating adjustment time that is based on the number of recording media outputted continuously, which is adjusted by a multiplier factor depending on the recording-medium size.

2. The fixing device according to claim 1, further comprising a pressing-member temperature detector to detect temperature of the pressing member, wherein the preheating-time adjuster adjusts the preheating time based on the temperature detected by the pressing member temperature detector and the recording-medium data acquired by the recording-medium data receiver.

3. The fixing device according to claim 2, further comprising an ambient-temperature detector to detect temperature around the recording media, wherein the preheating-time adjuster adjusts the preheating time based on the temperature detected by the ambient-temperature detector, the temperature detected by the pressing member temperature detector, and the recording-medium data acquired by the recording-medium data receiver.

4. The fixing device according to claim 2, further comprising a recording-medium temperature detector to detect recording-medium temperature, wherein the preheating-time adjuster adjusts the preheating time based on the temperature detected by the recording-medium temperature detector, the temperature detected by the pressing member temperature detector, and the recording-medium data acquired by the recording-medium data receiver.

5. The fixing device according to claim 1, further comprising an ambient-temperature detector to detect temperature around the recording media, wherein the preheating-time adjuster adjusts the preheating time based on the temperature detected by the ambient-temperature detector, and the recording-medium data acquired by the recording-medium data receiver.

6. The fixing device according to claim 1, further comprising a recording-medium temperature detector to detect recording-medium temperature, wherein the preheating-time adjuster adjusts the preheating time based on the temperature detected by the recording-medium temperature detector, and the recording-medium data acquired by the recording-medium data receiver.

7. The fixing device according to claim 1, wherein the preheating time includes a second preheating adjustment time that is added to the first preheating adjustment time, the second preheating adjustment time being based on the recording-medium type.

8. An image forming apparatus comprising:

an image forming unit to form an image; and a fixing device to fix the image formed by the image forming unit on a recording medium, the fixing device including a fixing member, a heating member to heat the fixing member, a pressing member to press against the fixing member with a predetermined pressure, forming a nip where an image is fixed on a recording medium with heat and pressure, a heating controller to cause the heating member to heat the fixing member to a predetermined temperature set in advance and to preheat the fixing member while maintaining the temperature of the fixing member, a recording-medium data receiver to acquire recording-medium data before a fixing process is started, and a preheating-time adjuster to adjust a preheating time based on the data acquired by the recording-medium data receiver, wherein the recording-medium data includes at least a recording-medium type, a recording-medium size, and a number of recording media outputted continuously, and wherein the preheating time includes a first preheating adjustment time that is based on the number of recording media outputted continuously, which is adjusted by a multiplier factor depending on the recording-medium size.

9. The image forming apparatus according to claim 8, the fixing device further comprising a pressing-member temperature detector to detect temperature of the pressing member, wherein the preheating-time adjuster adjusts the preheating time based on the temperature detected by the pressing-member temperature detector and the recording-medium data acquired by the recording-medium data receiver.

10. The image forming apparatus according to claim 9, the fixing device further comprising an ambient-temperature detector to detect temperature around the recording media, wherein the preheating-time adjuster adjusts the preheating time based on the temperature detected by the ambient-temperature detector, the temperature detected by the pressing-member temperature detector, and the recording-medium data acquired by the recording-medium data receiver.

11. The image forming apparatus according to claim 9, the fixing device further comprising a recording-medium temperature detector to detect recording-medium temperature, wherein the preheating-time adjuster adjusts the preheating time based on the temperature detected by the recording-medium temperature detector, the temperature detected by the pressing-member temperature detector, and the recording-medium data acquired by the recording-medium data receiver.

12. The image forming apparatus according to claim 8, the fixing device further comprising an ambient-temperature detector to detect temperature around of the recording media, wherein the preheating-time adjuster adjusts the preheating time based on the temperature detected by the ambient-temperature detector and the recording-medium data acquired by the recording-medium data receiver.

13. The image forming apparatus according to claim 8, the fixing device further comprising a recording-medium temperature detector to detect recording-medium temperature, wherein the preheating-time adjuster adjusts the preheating time based on the temperature detected by the recording-medium temperature detector and the recording-medium data acquired by the recording-medium data receiver.

14. The image forming apparatus according to claim 8, wherein the image forming unit comprises multiple image carriers and forms multiple different single-color images thereon, respectively, and the single color images are superimposed one on another into a multicolor image.

15. The image forming apparatus according to claim 8, wherein the preheating time includes a second preheating adjustment time that is added to the first preheating adjustment time, the second preheating adjustment time being based on the recording-medium type.

16. A control method for a fixing device including a fixing member, a heating member, and a pressing member, the control method comprising:

acquiring recording-medium data about a recording medium, on which an image is fixed, before a fixing process is started, the recording-medium data including at least a recording-medium type, a recording-medium size, and a number of recording media outputted continuously;

determining a preheating time during which the heating member preheats the fixing member based on acquired recording-medium data, the determined preheating time including a first preheating adjustment time that is based on the number of recording media outputted continuously, which is adjusted by a multiplier factor depending on the recording-medium size;

heating the fixing member to a predetermined temperature set in advance; and preheating the fixing member for the determined preheating time while maintaining a temperature of the fixing member at the predetermined temperature.

17. The control method according to claim 16, further comprising detecting temperature of the pressing member, wherein the preheating time is adjusted based on the detected temperature of the pressing-member and the acquired recording-medium data.

18. The control method according to claim 16, further comprising detecting temperature around the recording media, wherein the preheating time is adjusted based on the detected temperature around the recording media and the acquired recording-medium data.

19. The control method according to claim 16, further comprising detecting temperature of the recording media, wherein the preheating time is adjusted based on the detected temperature of the recording medium and the acquired recording-medium data.

20. The control method according to claim 16, wherein the determined preheating time includes a second preheating adjustment time that is added to the first preheating adjustment time, the second preheating adjustment time being based on the recording-medium type.

* * * * *